US009821216B2

(12) United States Patent
Kurtin et al.

(10) Patent No.: US 9,821,216 B2
(45) Date of Patent: Nov. 21, 2017

(54) MODULAR BARRIER SYSTEM

(71) Applicant: Lane Research, Sherman Oaks, CA (US)

(72) Inventors: Stephen Kurtin, Sherman Oaks, CA (US); Scott Winslow, Chatsworth, CA (US); Brian Packard, North Andover, MA (US)

(73) Assignee: LANE RESEARCH, Sherman Oaks, CA (US)

( * ) Notice: Subject to any disclaimer, the term of this patent is extended or adjusted under 35 U.S.C. 154(b) by 0 days.

(21) Appl. No.: 15/412,882

(22) Filed: Jan. 23, 2017

(65) Prior Publication Data

US 2017/0209775 A1 Jul. 27, 2017

Related U.S. Application Data

(60) Provisional application No. 62/286,810, filed on Jan. 25, 2016.

(51) Int. Cl.

| | |
|---|---|
| ***A63C 19/06*** | (2006.01) |
| ***E04H 17/18*** | (2006.01) |
| ***E01C 13/10*** | (2006.01) |
| ***F25C 3/02*** | (2006.01) |

(52) U.S. Cl.

CPC ..... *A63C 19/06* (2013.01); *E01C 13/105* (2013.01); *E04H 17/18* (2013.01); *F25C 3/02* (2013.01)

(58) Field of Classification Search

CPC ..... E01C 1/002; E01C 11/111; E01C 13/045; E01C 13/065; E01C 13/105; E01C 5/005; E01C 2201/207; E01F 15/083; E01F 15/088; A63C 19/00; A63C 19/02; A63C 19/10

USPC ..... 472/88–92; 404/6–7; 160/135

See application file for complete search history.

(56) References Cited

U.S. PATENT DOCUMENTS

| | | | | |
|---|---|---|---|---|
| 4,068,968 | A * | 1/1978 | Gagle | E01C 11/222 404/17 |
| 5,611,641 | A | 3/1997 | Christensen | |
| 5,669,227 | A | 9/1997 | Morris | |
| 5,820,470 | A | 10/1998 | Saunders | |

(Continued)

OTHER PUBLICATIONS

"NiceRink", "http://www.nicerink.com", downloaded from the Internet on Jan. 9, 2017.

(Continued)

*Primary Examiner* — Kien Nguyen

(74) *Attorney, Agent, or Firm* — Chen Yoshimura LLP

(57) ABSTRACT

A portable ice rink includes a wall formed of multiple wall members linearly disposed adjacent to one another to form a piecewise continuous wall that encloses a desired area, and also includes a chain of links disposed on the outside of the wall members for reinforcement. The rink may further include a waterproof tarp extending underneath the wall members and folded upwards along the outer side of the wall, with its edge tied to the change of links. The tarp can contain water which then freezes to form a skating surface. Curved wall members are provided to form a rink with round corners. Each wall member is a discrete unit, made of molded plastic, and having a hollow interior which can be filled with water (or other ballast). Each wall member is designed with stiffening features to maintain the flatness of its inner surface after filling.

19 Claims, 6 Drawing Sheets

(56) References Cited

U.S. PATENT DOCUMENTS

| | | | | |
|---|---|---|---|---|
| 5,882,140 | A | 3/1999 | Yodock, Jr. et al. | |
| 5,988,934 | A * | 11/1999 | Wasserstrom | E01F 15/083 256/13.1 |
| 6,517,442 | B1 | 2/2003 | Post | |
| 6,669,402 | B1 * | 12/2003 | Davis | E01F 15/088 256/13.1 |
| 6,957,546 | B1 | 10/2005 | Farley et al. | |
| 7,849,653 | B2 | 12/2010 | Guertin | |
| 2007/0110517 | A1 | 5/2007 | Wasserstrom et al. | |
| 2007/0116522 | A1 | 5/2007 | Boudreaux | |
| 2009/0003931 | A1 * | 1/2009 | Christensen | B29C 49/482 404/6 |
| 2009/0049785 | A1 | 2/2009 | Guertin | |
| 2013/0105475 | A1 | 5/2013 | Marshall | |

OTHER PUBLICATIONS

International Search Report in related PCT application No. PCT/US2017/014570, dated May 30, 2017.

Written Opinion in related PCT application No. PCT/US2017/014570, dated May 30, 2017.

* cited by examiner

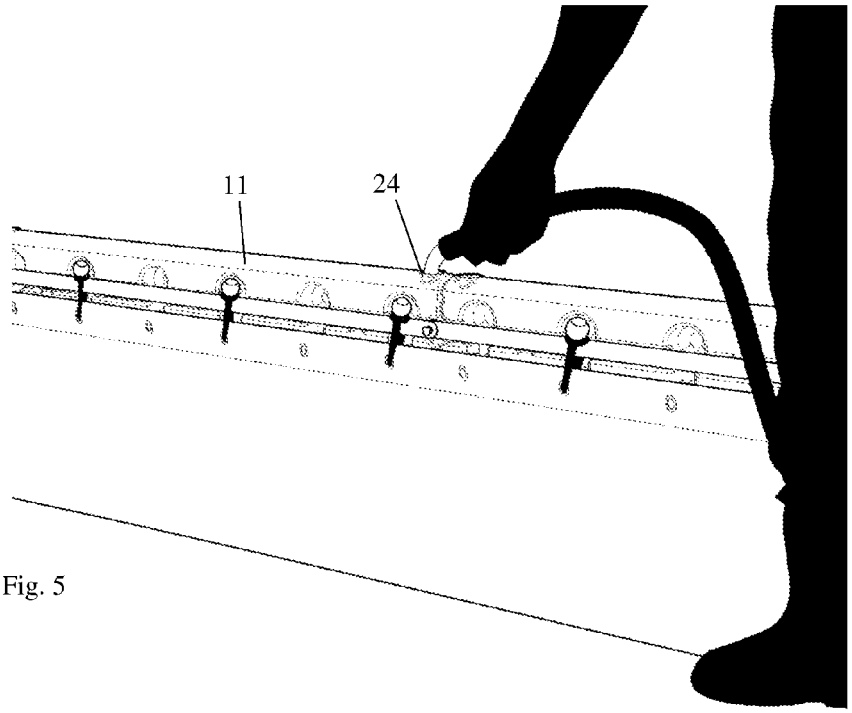
Fig. 5
Fig. 6
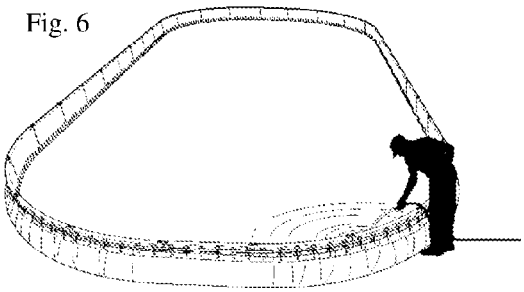
Fig. 7
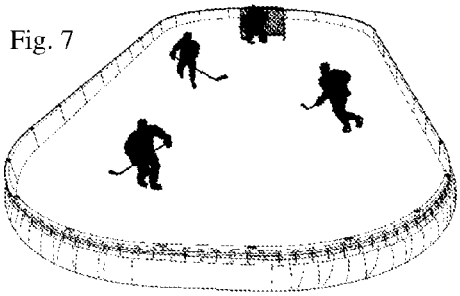
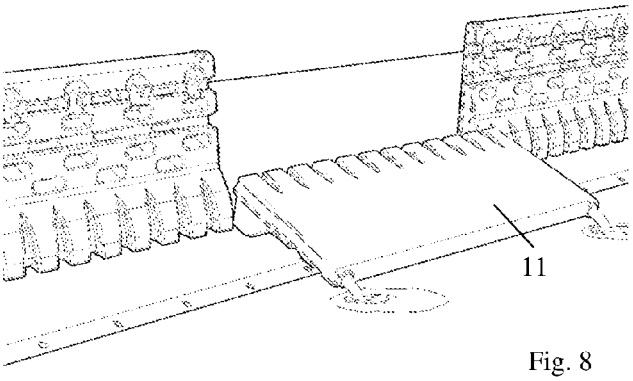
Fig. 8

MODULAR BARRIER SYSTEM

BACKGROUND OF THE INVENTION

Field of the Invention

This invention relates to modular barrier systems. For example: a modular system to construct a wall that defines a playing field, or to create an ice hockey rink.

Description of Related Art

Systems for creating outdoor ice skating, or ice hockey, rinks are known. For example a commercially available system, called "NiceRink", enables a backyard ice rink having a peripheral wall constructed from boards and support brackets, with a waterproof liner placed over the enclosed area and folded upwards and then over the peripheral wall. The liner holds water which is allowed to freeze to form a skating surface.

U.S. Pat. No. 5,669,227 describes "a portable ice skating rink including elongate curb structural members and a liner of flat flexible sheet material. The liner is economically made of sheet plastic for example with a bottom sheet and elongate sleeves around the periphery of the bottom sheet. The curb members, such as 4×4 lumber pieces, are inserted into an open end of each sleeve to form a water retaining structure. The sheet material and seams have resistance to water permeation sufficient to retain a shallow pool of water covering the bottom sheet during freezing in outdoor conditions to form an ice skating surface."

U.S. Pat. No. 6,517,442 describes "an enclosure which has a plurality of utilities such as a portable ice skating rink, a wading pool, a volleyball area, and a garden enclosure. The enclosure has a pair of opposed sidewalls and a pair of opposed end walls. Each of the sidewalls is defined by at least one elongated sidewall member and each of the end walls is defined by at least one elongated end wall member. A plurality of corner members define an enclosed area with the end walls and the sidewalls. The enclosure further has at least one sheet member positioned over the sidewalls, the end walls, and the corner members. The enclosure further has cover members which fit over the elongated sidewall members, the end wall members, and the corner members to hold and protect the at least one sheet member."

U.S. Pat. No. 6,957,546 describes a "portable ice skating rink [which] comprises, in a kit, a plastic sheeting, a protective band for the sheeting, and a number of rigid tubular members, flexible connectors and corrugated clips. To assemble the kit, the tubular members are connected to each other in a closed loop using the flexible connectors inserted in facing ends thereof and with corners of the loop being formed by curving some flexible connectors. The sheeting is then laid over the ground of the area enclosed by the loop while extending outwardly over and past the loop. The protective band is laid over the sheeting opposite the loop and the clips are installed thereat to secure the sheeting to the so formed frame with the clips running continuously all along the frame such as to protect the sheeting. Portions of the frame can be raised to level it and the sheeting can then be pulled."

Modular barrier systems for other applications are also known. For example, U.S. Pat. No. 5,611,641 describes a "portable crowd control barrier for use in sporting or entertainment events [which has] lightweight body members formed of a resiliently deformable material and each defining an interior chamber and having slots formed in end walls thereof to receive wooden studs such that the introduction of liquid into the interior chambers deforms the body members, clamping the walls of the slots against the studs and locking the system in place."

U.S. Pat. No. 5,820,470 describes a "portable modular outdoor playing arena having a plurality of modular floor panels and a plurality of generally vertically oriented modular side panels. The floor panels have a generally smooth flat upper surface and side surfaces that depend therefrom at approximate right angles. The floor panels are adjoined in a closed polygonal configuration to create a playing surface. The side panels surround and abut the floor panels and exert a compressive force on the floor panels to prevent lateral separation of adjacent floor panels. A seal forms a fluid tight connection between adjacent floor panels and at the juncture of the floor panels and the side panels. Each of the floor panels include adjustable legs to support the floor panels on the ground or on a sub-surface. The legs are vertically adjustable to allow for the levelling of the floor panels so that adjacent floor panels can be individually levelled and supported to provide a level playing surface."

U.S. Pat. No. 7,849,653 describes an "anchoring panel for a sport wall system with a front side facing an interior of the sport wall system, a back side, a flange extending from and rigidly fixed to the back side, a top side, a bottom side, and a first and second end wall is provided. Each of the first and second end walls include interlocking elements for interlocking with a first or second end of another panel in the sport wall system, the interlocking elements comprising at least a male knob extending towards the bottom side of the anchoring panel and configured to be insertable into a panel recess of the another panel in the sport wall system."

SUMMARY

The present invention is directed to an improved modular barrier system, its components, and a related installation method.

An object of the present invention is to provide a low cost barrier system that enables outdoor skating, or ice hockey, rinks which are robust and convenient to install.

Additional features and advantages of the invention are set forth in the descriptions that follow, and in part will be apparent from that description, and/or from the appended drawings, or may be learned by practice of the invention.

To achieve these objects, as embodied and broadly described, the present invention provides a modular barrier system which includes a plurality of plastic wall members, together with a plurality of elongated links.

In another aspect, the present invention provides a plastic wall member for a modular barrier system which is preferably fabricated by blow molding, and includes a variety of topological stiffeners; for example: a range of shallow ribs, and also rows of deeply blown tack-offs.

In another aspect, the present invention provides a method for installing a modular barrier system which includes i) linearly aligning the plastic wall members to form a piecewise continuous wall enclosing a defined area; ii) properly positioning the links with respect to the aligned wall members; and iii) connecting each link to its nearest neighbors via a demountable fastener.

It is to be understood that both the foregoing general description and the following detailed description are exemplary and explanatory; these descriptions are not intended to limit the scope of the invention as further explained below, nor as claimed.

BRIEF DESCRIPTION OF THE DRAWINGS

FIGS. 1-5 illustrate a modular barrier system for an ice rink according to an embodiment of the present invention, including the structures of its components and its installation process.

FIGS. 6 and 7 illustrate the completed modular barrier system.

FIG. 8 illustrates the modular barrier system being taken down.

DETAILED DESCRIPTION OF PREFERRED EMBODIMENTS

Figure 1:
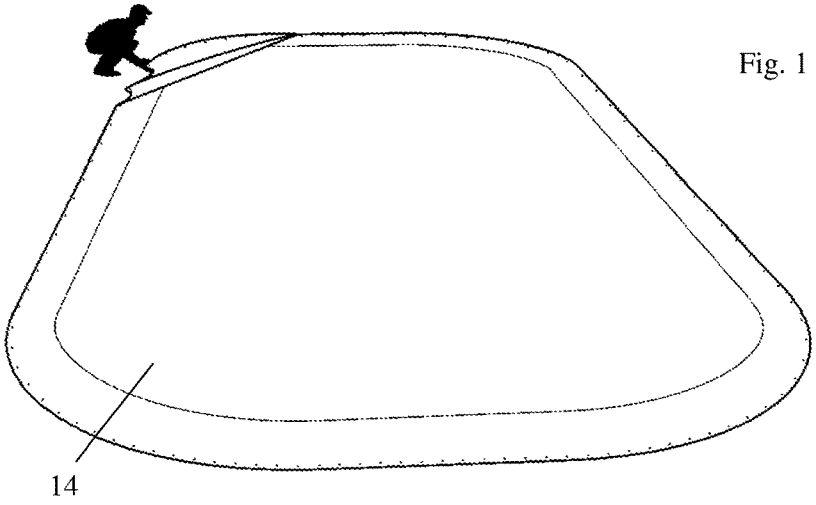

Embodiments of the present invention provide a modular barrier system (i.e., a set of manufactured items), intended to be installed on a plot of ground to define an area. Applications of the modular barrier system include, for example, rinks for skating or ice hockey; barriers for crowd control, or barriers for temporary protection of construction areas. For convenience and clarity the descriptions below are in the context of a rink for backyard ice hockey; but the invention is not limited to that application.

A modular barrier system according to an embodiment of the present invention intended for backyard ice hockey is described below with reference to FIGS. 1-8, which illustrate the structures of its components and its installation process, use and dismount.

The modular barrier system includes: a plurality of wall members 11 (including straight and curved wall members), a plurality of links 12 (including straight and curved links, each preferably having at one end a thread-clearance hole and at the other end a permanently installed, internally threaded, nut); a plurality of demountable fasteners 13 (for connecting the links to each other preferably by passing through the clearance hole at the end of one link and threading into the nut at the proximate end of its nearest neighbor), a waterproof tarp 14, and a plurality of tying cords 15.

Each wall member 11 is a discrete item. Each link is also a discrete item, and preferably has a length, and curvature, that conforms to its corresponding wall member.

In the installed state of the ice rink system, a plurality of straight and curved wall members 11 are linearly aligned to form a piecewise continuous wall that encloses, and thereby defines, a desired area. It is preferred that no appreciable gaps (as compared to the size of the hockey puck, for example) are present between adjacent wall members. The straight and curved links 12 are placed against the outside of the wall 10. The links are connected to each other by the fasteners 13 thereby forming a closed chain (also, herein, called a "chain of links"). The fasteners 13 are preferably thumbscrews, but may alternatively be, for example, bolts and nuts, hooks, or springs. (Note: In this specification, "inner", "inside", and "front" mean facing the skaters; the corresponding opposite is referred to as the "outer", "outside" or "back".)

Figure 2:
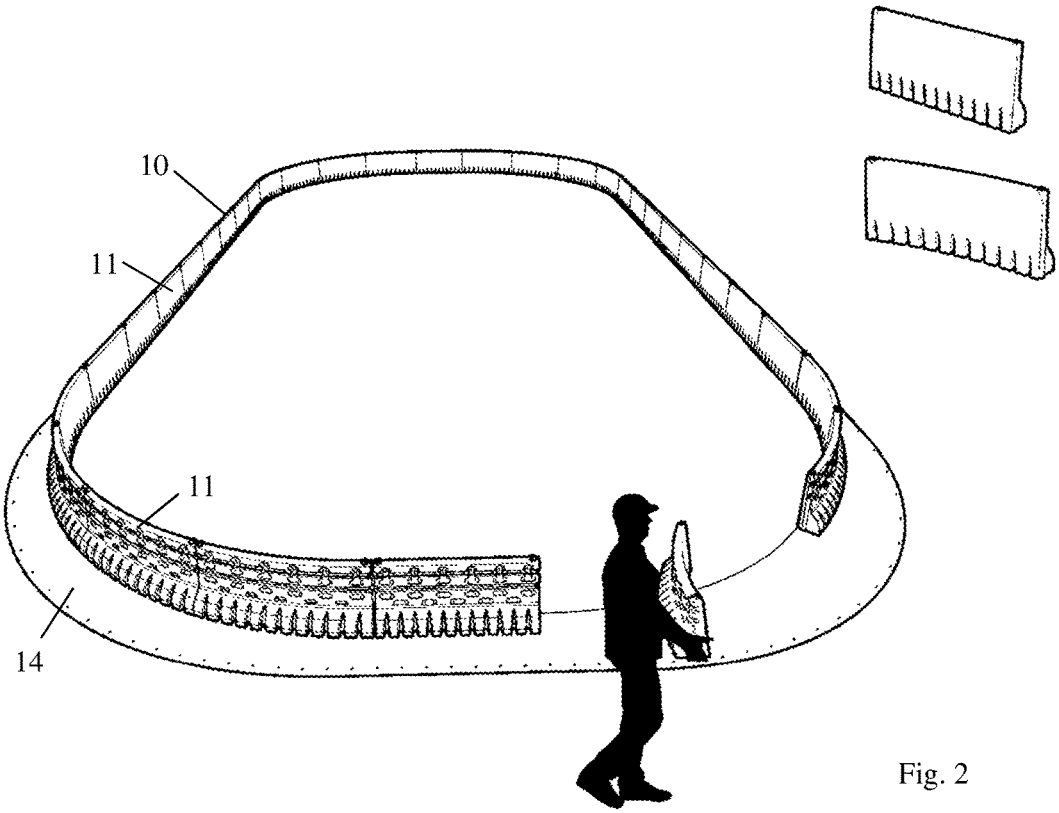
Figure 4:
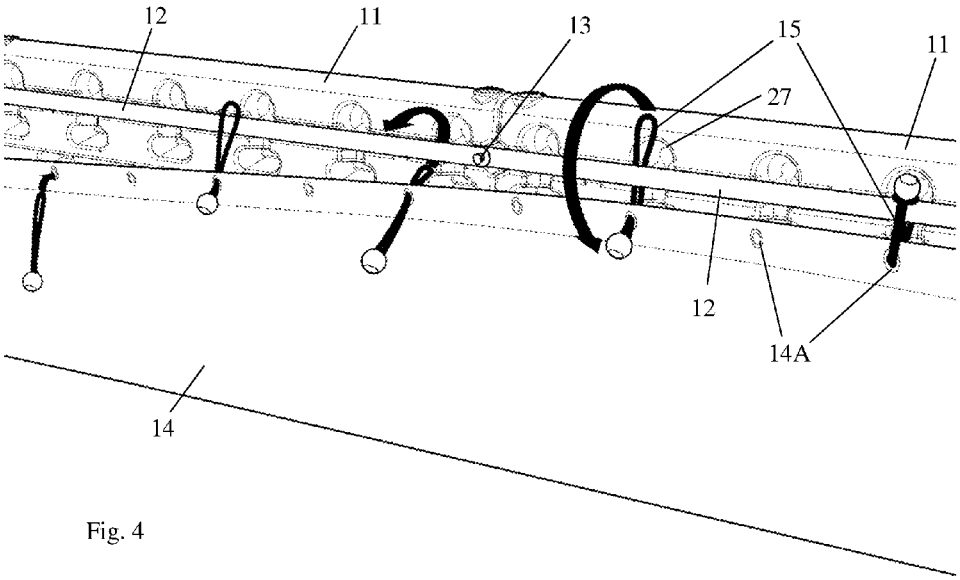

As shown in FIGS. 1 and 2, the tarp 14 covers the entire area defined by the wall 10 of wall members 11, and also extends underneath the wall, and beyond it in every direction for a distance that is somewhat less than the height of the wall, e.g., a distance of approximately 12 inches. After the links have been installed the extended portion of the tarp is folded upwards against the outside of the wall members, and tied to the links 12 using the tying cords 15, as shown in FIG. 4. For this purpose the tarp 14 is preferably provided with a series of grommets 14A, near its edge, for passing the cords. The tying cords are preferably ball bungees as shown in FIG. 4, but may alternatively be, for example, cable ties, hook-and-loop webbings, or webbing with buckles or snaps, etc. In alternative embodiments the tarp may be provided with a plurality of webbing or tying lines, stitched to its edge, thereby providing a means to secure the tarp to the chain of links.

In preferred embodiments the tarp 14 is flat and, except for the grommets, free of any structures such as pockets. In practice, consistent with modularity, for each size of rink a mating tarp is provided. For convenience, and best appearance, the tarp may have rounded corners matching the outer periphery shape of the wall 10, as seen in FIGS. 1 and 2.

The number of straight and curved wall members 11 and the straight and curved links 12 is determined by the lengths of these items and the desired size and shape of the ice rink. In preferred embodiments, the rink has a basically rectangular shape but with four smoothly curved corners. In one preferred embodiment, four curved wall members and four curved links form each 90-degree corner. The curvature of the curved wall members, and therefore of each curved link is determined by the desired curvature of the corners. In alternative embodiments, the ice rink may have 90 degree corners, or segmented corners.

After the modular barrier system is installed, each wall member 11 is filled with ballast, preferably water. Filling a wall member with water greatly increases the wall member's mass, and (for cold weather applications) after the water freezes also significantly increases its rigidity. Thereafter water is introduced into the area enclosed by the wall 10, being contained by the folded tarp 14. Typically a layer of water having a minimum depth of about 4 inches is sufficient. To the extent that the wall 10 is installed on a non-level plot of ground, the depth of layer of water will naturally be greater in some locations than in others. The water is allowed to freeze, thereby becoming the skating surface.

Prior art modular barrier systems typically rely on stakes driven into the ground to locate, and secure, the walls of the rink. To create an ice rink a tarp cannot be passed under the walls of such a barrier system because, if so passed, the tarp would be punctured by staking, thereby creating leaks. In embodiments of the present invention no stakes are utilized, neither to secure the wall members nor for any other reason. Instead the wall members are simply put into place (if a tarp is to be used, on top of the tarp as shown in FIG. 2) and then the free edge of the tarp—now located outside the wall 10—is folded upward.

Because the edge of the tarp is folded upwards outside of the wall members, the inner surfaces of the wall members themselves constitute the inner wall surface of the ice rink. Since no tarp faces the skaters, the tarp is not exposed to damage by skates (or hockey sticks) during play, and tarp ripples are irrelevant to puck travel. These factors foster smooth flow of the game, and predictable flight of the puck. To the contrary, in prior modular ice skating rink systems where the tarp is folded upwards inside the wall, a smooth surface is very difficult to obtain, especially in the corners.

The shape of a straight wall member 11 in one preferred embodiment is illustrated in FIGS. 9A-H, showing respectively front, left, right, top, bottom, back, front perspective and back perspective views. It is also preferred that the curved wall members have a similar structure except, of course, that they are curved in the top and bottom views. The descriptions below generally apply to both the straight and curved wall members.

The front view of each wall member 11 is substantially rectangular. Each wall member is preferably approximately 18 inches high, although other heights may be used. The lower portion (i.e. base) 25 of each wall member is preferably deeper than the upper portion (as used here, "depth" refers to the front-to-back direction). In the illustrated embodiment, the base 25 is approximately 6 inches deep. The relatively greater depth of base 25 provides stability, particularly during rink assembly. The shape of base 25 also preferably mimics the shape that the tarp 14 (wrapped around the outside of each wall member) will take when the rink is filled with water to begin creating an ice skating surface.

The wall members 11 are preferably formed from low-cost weather-resistant plastic, preferably HDPE and preferably via blow molding. For ice rink applications, to minimize the heating effect of sunlight, the wall members are preferably molded of white plastic. In essence each wall member is a hollow shell (i.e., bottle) enclosing hollow space, the shell being watertight except for one or more openings 24, located near its topmost surface, to allow filling with water (or another form of ballast). Optionally the opening may include threads, and accept a cap or plug.

As previously described one goal of the invention is to provide a low cost modular barrier system. It is therefore desired that the walls of each wall member be relatively thin. As also mentioned above, the front wall of each wall member is intended to be relatively smooth and flat (except for the intended curvature of the curved wall members). These goals are not easily met. For example, absent adequate countermeasures, after ballast is added to a wall member hydrostatic pressure will tend to cause unacceptable bulging, locally and/or globally. As to blow molded items with lesser front-to-back depth it is well known to consider topological stiffening features, like depressions and/or tack-offs ("tack-offs" being local welds, between the front and rear walls of a blow molded item, created during molding).

Given the objectives at hand, however, it is not obvious that suitable wall members can be designed. One key reason being that stretching of the thermoplastic resin, and corresponding thinning of the resulting walls, is inherent to the blow molding process. Forcing excessive stretch can make it impossible to control wall thickness of the wall members, and/or cause the parison to rupture. The extent of stretching that occurs in blow molding is determined by the degree of asymmetry in the basic part shape, and also by the complexity of the part's local features (the latter typically characterized by "blow ratios", these being the relationships between the depth and width of various depressions).

As illustrated in the preferred embodiment shown in FIGS. 9A-H and 10, and discussed below, the inventors found a solution via a unique multiplicity of topological stiffening features. This solution allows the thickness of some regions of the wall of a wall member to be as thin as about 0.04", and the average thickness of the parison from which it is molded to be as thin as about 0.06". In other embodiments the thickness of some portions the wall of a wall members can be as thick as 0.08".

More specifically, in a preferred embodiment, to control wall bulging the lower regions of each wall member 11 are provided with a plurality of shallow stiffening grooves 21. These extend front-to-back across the bottom face and upwards on both the front and back sides. On the front side, the shallow stiffening grooves 21 preferably terminate below the minimum height of the intended skating surface; on the back side, however, the shallow stiffening grooves 21 may extend the full height of the base 25. The grooves extending under the bottom face serve a secondary purpose of allowing water to flow easily under the wall 10.

With similar bulge control motivation in a preferred embodiment all wall members 11 are also provided, on their back face, with a plurality of deep "tack-off" depressions 22, each of which is welded to a proximate region of its front wall during molding. Each tack-off locally thickens a portion of the front wall, thereby reducing local bulging. Moreover, the array of deep depressions 22 forms a network of front-to-back ribs which limits global deformation of the front wall under load. In the preferred embodiment shown in FIGS. 9A-H, incorporates five rows of horizontally staggered tack-offs, located starting just above the base 25, and packed as closely as blow ratio considerations allow (each row having five or six depressions).

The sizes and locations of grooves 21 and depressions 22 were determined as follows: Starting with a set of initial grooves 21 and depressions 22, all stipulated by insight and constrained to be consistent with proven blow molding practices, a candidate wall member was modeled in 3-D CAD software (for example, SolidWorks). The model was then statically loaded as if filled with ballast, and resulting deformations simulated via finite element analysis (FEA). Observing those regions which bulge excessively, the location and configuration of various grooves and depressions were modified, and the model re-analyzed. This process was iterated, thereby evolving the candidate design. It is worth noting that, given the goals of the invention, during iteration it was not clear that a viable solution could be developed.

Figure 9D:
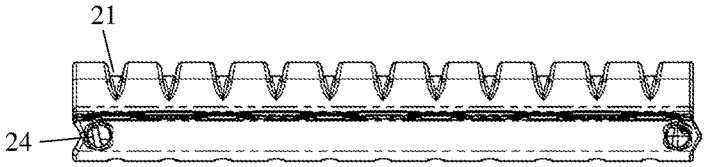
FIGS. 9A-H are various views showing a straight wall member of the modular barrier system of the embodiment.
Figure 9B:
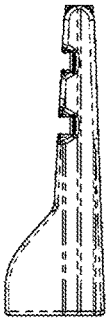
Figure 9A:
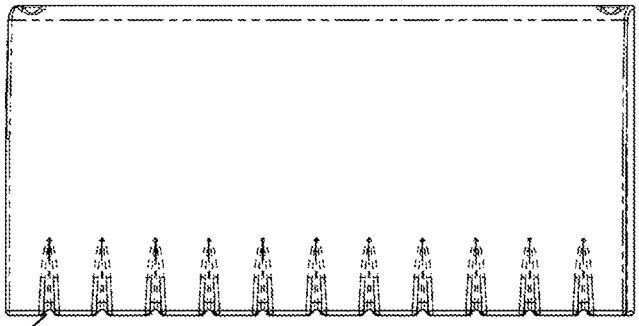
Figure 9C:
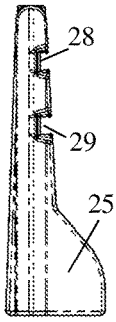
Figure 9E:
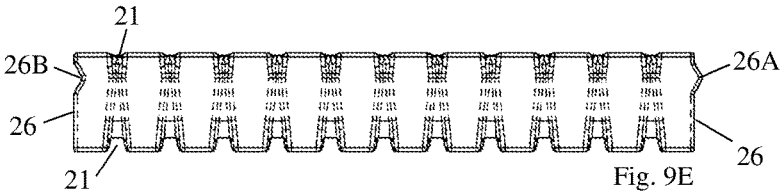
Figure 9F:
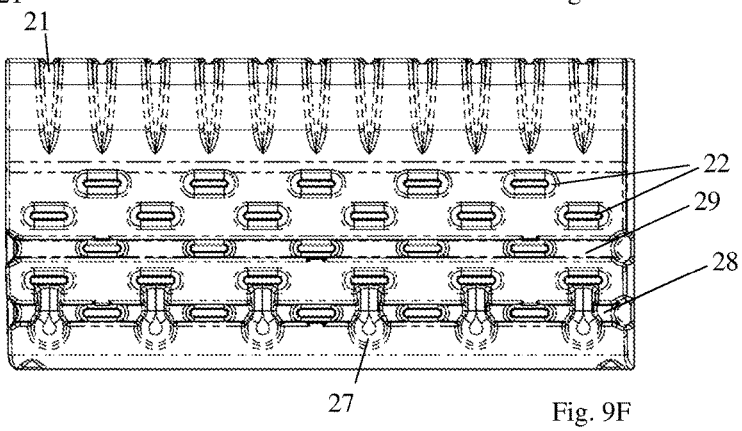
Figure 9G:
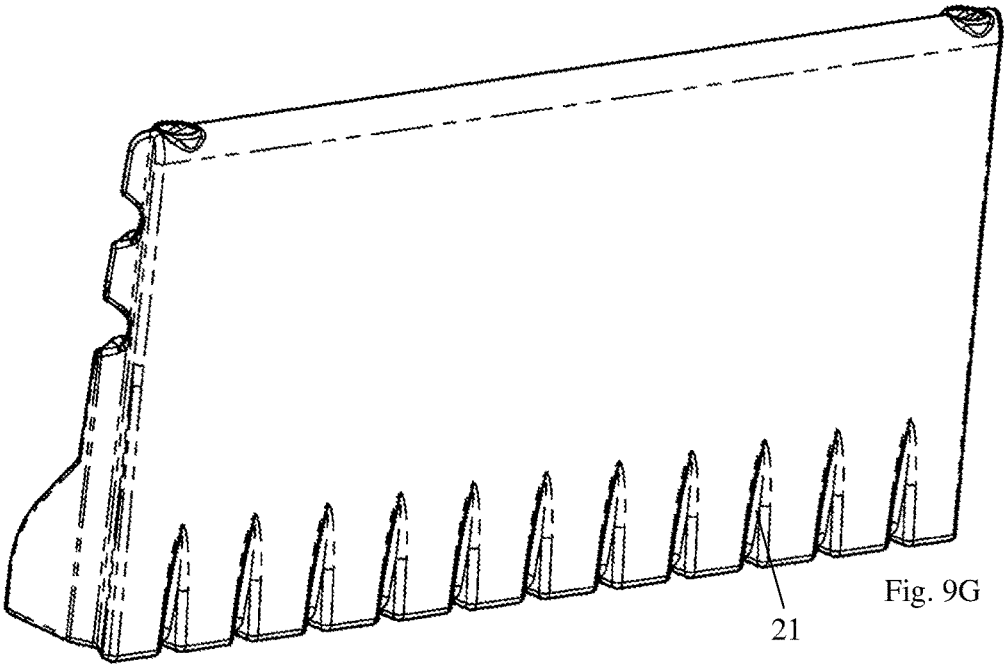
Figure 9H:
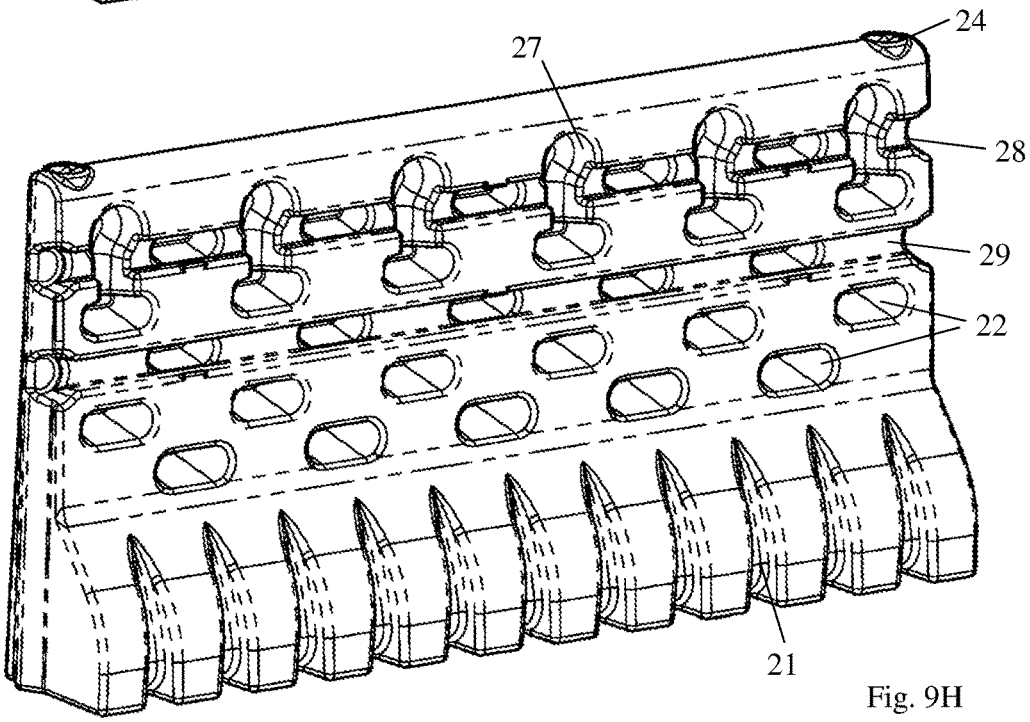

In preferred embodiments, as to each wall member 11 one longitudinal end face 26 is shaped to include one or more recesses 26B, and the other longitudinal end face 26 is shaped to include one or more protrusions 26A (see FIGS. 9D-E). The recesses and protrusions have mating shapes, and are located to allow the protrusions of one wall member to fit into the recesses of a linearly aligned adjacent wall member. In the embodiment shown in FIGS. 9A-H, only one recess and one protrusion are provided, each extending in the vertical direction for the entire height of the wall member and having a V shaped cross-section in the top view. In other embodiments, the protrusions and recesses may have other shapes. For example: the cross-sectional shape (in the top view) may be rectangular; multiple recesses and protrusions may be provided; the recesses and protrusions may have a round shape in the side view of the wall members.

During the wall member alignment phase of barrier assembly, the protrusions of each wall member are mated with the corresponding recesses of its nearest neighbor. Particularly for a rink for ice hockey, skater impact with wall members can be so substantial that, notwithstanding the weight of each individual wall member after having been filled with water, the modest interlock formed by the recesses and protrusions (more specifically, the V-shaped vertical grooves and protrusions in the embodiment shown in FIGS. 9D-E) is typically inadequate to create a robust rink. Which is to say that, without suitable additional restraint, during a substantial impact one wall member may separate from the next. The inventors investigated many approaches to providing the needed additional restraint. Ultimately they determined that a belt, surrounding the entire outer perimeter of wall 10, would not only dissipate local impact loading but also enable the entire mass of the rink to act to resist translational motion.

The inventors quickly learned that many types of "belt" would not function as desired. For example, no matter how tightly tied, a rope around the outside of a rink cannot provide satisfactory restraint. The key reason being that all ropes (including wire ropes) suffers from low stress initial elongation and also from subsequent creep. Eventually it was found that appropriate restraint can best be provided by a "chain of links" as discussed below.

Figure 3:
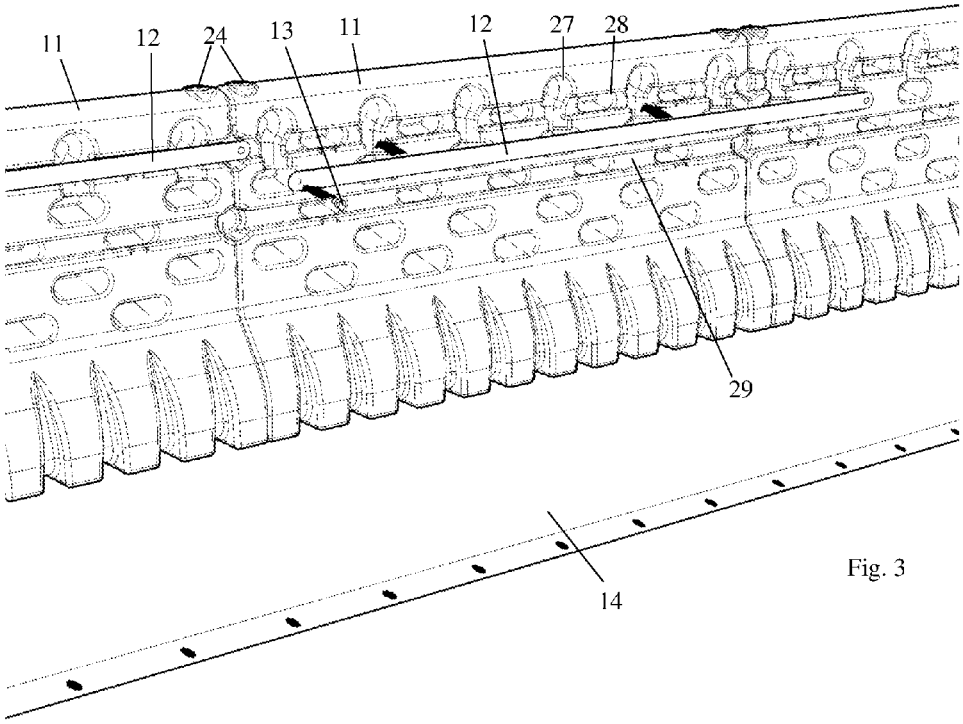
Figure 11:
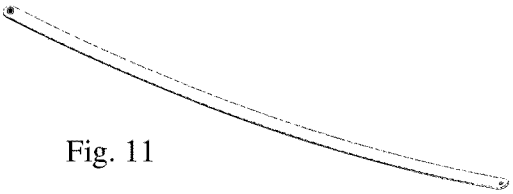
FIG. 11 illustrates a single curved link of the embodiment.
Figure 10:
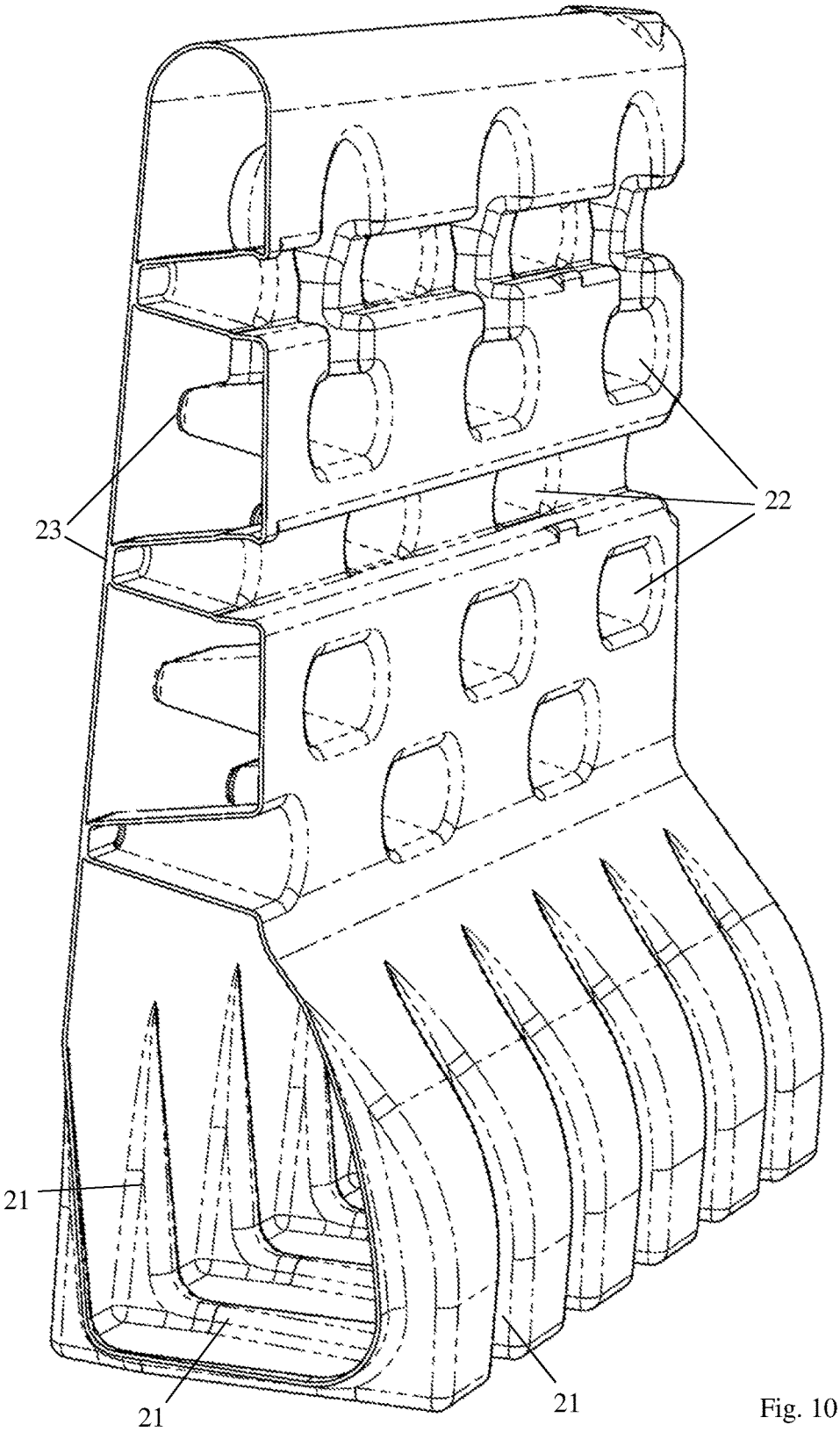
FIG. 10 is a partial cut-away view that illustrates the structure of a wall member of the modular barrier system.

In a preferred embodiment, each link 12 is a strap formed from steel and galvanized to resist corrosion. (Alternatively, for example, painted steel, or stainless steel, may be utilized.) A curved link is shown in FIG. 11. Each link has at one end a pressed-in threaded nut and, at the other end, a corresponding thread-clearance hole. As a rink is assembled, a link 12 is snapped into a horizontal first link-accepting groove 28 on the back side of each successive wall member 11, and fastened to its nearest neighbor links using the threaded nut on one link and the thread clearance of the other by a fastener (thumbscrew) 13, as shown in FIGS. 3 and 4. In the embodiment illustrated in FIGS. 3 and 4, the joining locations of the links 12 coincide with the locations where two wall members 11 abut each other; alternatively, the joining locations of the links may be offset from where wall members abut one another. Note further that in other embodiments neither wall members, nor links, need be of consistent length. Additionally, if desired, features to aid the positioning of each link need not be link-accepting grooves. For example, alternative locating features such as step features may be molded into (or installed onto) wall members, or omitted.

In preferred embodiments no links are present against the front side of the wall members 11, nor does the upper portion of the front side include any geometric features, so that the inner face of wall 10 is smooth except for the grooves 21 in the lower portion.

In combination with the wall members discussed above, the chain of links takes up each skater impact, primarily by loading in tension. On impact a wall member may momentarily separate somewhat from its neighbors and then promptly to return into place, urged by recovery of the impact-induced elastic elongation of the chain of links.

Note also that, when filled with ballast, each wall member will expand to some extent along its lengthwise direction (i.e. the circumferential direction of the rink wall 10). This expansion provides post-tensioning of the chain of links, since the wall members are intended primarily to be filled with ballast after the chain of links has been installed.

Optionally, each wall member may include a second link-accepting groove 29 (see FIGS. 3 and 9A-H), located below the first groove 28, thereby providing the optional ability to enhance impact resistance by installation of a second chain of links.

The chain of links also provides a convenient peripheral location along which to install as many, or as few, tying cords 15 as desired. In a preferred embodiment, additional recesses 27 are provided along the first link-accepting groove 28 for the tying cords to pass behind the links (see FIGS. 3, 4 and 9A-H). In the illustrated embodiment, the tarp 14 is tied to the links 12 only. In alternative embodiments it is also possible to provide features on the wall members to which the tarp may be tied. This, however, would increase the complexity of the wall member.

In summary, to install the ice rink the tarp 14 is laid on the ground (FIG. 1), and the wall members 11 are placed on the tarp at appropriate locations (FIG. 2) (in a preferred embodiment the tarp is printed with a line to indicate the intended periphery). The links 12 are successively snapped into link-accepting grooves 28 (on the back side of the wall members) and fastened together (FIG. 3). The edge of the tarp 14 is folded upwards along the back of the wall 10, and tied to the links 12 (FIG. 4). Water having been introduced into each wall member (FIG. 5), either before or after the tarp is fastened into place, water is also introduced into the rink (FIG. 6) and allowed to freeze, forming the skating surface (FIG. 7). Water can be poured out from each wall member when the wall 10 is taken down (FIG. 8).

To summarize further, embodiments of the present invention provide a modular barrier system, suitable for various applications, including particularly for creating rinks in which to play ice hockey. This modular barrier system has many advantages. For example, it is robust, low cost, lightweight, modular, relatively compact when stored, easy to assemble (or disassemble) without tools, suitable for installation on a lawn, frozen pond, parking lot or tennis court, etc. It can create rinks with continuously curved corners, smooth and flat inner walls, and inner surfaces unlikely to be damaged by contact with ice skate blades.

It will be apparent to those skilled in the art that various modification and variations can be made in the modular barrier system, its components and related installation method of the present invention without departing from the spirit or scope of the invention. Thus, it is intended that the present invention cover modifications and variations that come within the scope of the appended claims and their equivalents.

What is claimed is:

1. A wall member for a modular barrier system, comprising a shell enclosing a hollow interior space, and one or more openings in fluid communication with the hollow interior space, wherein the shell is formed of a weather-resistant plastic by blow molding, wherein an average thickness of the shell is no more than 0.08 inches, wherein an upper portion of a front side of the shell, the upper portion extending a full horizontal length of the shell, is smooth without indentations, and wherein the shell includes a plurality of deep depressions on a back side, each deep depression terminating in a tack-off area joined to an inner surface of the shell on the front side of the shell.

2. The wall member of claim 1, wherein the shell further includes a plurality of shallow grooves which extend across a bottom face between the front side and the back side and extend upwards along both the front and back sides.

3. The wall member of claim 1, wherein a lower section of the wall member is deeper between the front and back sides than an upper section of the wall member.

4. The wall member of claim 1, wherein the wall member has two longitudinal end faces, one end face having one or more recesses and the other end face having one or more protrusions, the recesses and protrusions having mating shapes and corresponding locations.

5. The wall member of claim 1, wherein the wall member includes a horizontal groove on the back side.

6. A modular barrier system comprising:

a plurality of plastic wall members, each including a shell which encloses a hollow space, and each linearly aligned with its nearest neighbor, thereby forming a piecewise continuous wall enclosing an area defined by that wall;

a plurality of elongated links, each link having two ends, each end being connected to an end of its nearest neighbor thereby forming a closed chain, the chain being disposed against an outside of said wall, the outside of the wall being a side of the wall facing away from the enclosed area; and a waterproof tarp extending over the defined area, and underneath and beyond the wall, an edge of the tarp being folded upwards along the outside of the wall and secured to the links.

7. The modular barrier system of claim 6, further comprising a plurality of tying cords for securing the edge of the tarp to the links, wherein the edge of the tarp includes a plurality of grommets through which the tying cords pass.

8. The modular barrier system of claim 6, wherein the plurality of wall members include straight wall members and curved wall members, and the plurality of links include straight links and curved links, and wherein the curved wall members form curved corners of the wall.

9. The modular barrier system of claim 6, wherein an upper portion of an inner side of each wall member is smooth without indentations, the inner side of the wall member being a side of the wall member facing the enclosed area.

10. The modular barrier system of claim 6, wherein the shell of each wall member is blow molded of a weather-resistant plastic and is otherwise watertight having at or near its top surface one or more openings.

11. The modular barrier system of claim 10, wherein each wall member includes a plurality of shallow grooves extending across its bottom face and extending upwards along both its inside and outside faces.

12. The modular barrier system of claim 10, wherein each wall member includes a plurality of deep depressions on its outside, each deep depression terminating in an area that is welded to an inner side, the inner side of the wall member being a side of the wall member facing the enclosed area.

13. The modular barrier system of claim 6, wherein each wall member has two longitudinal end faces, one end face having one or more recesses and the other end face having one or more protrusions, the recesses and protrusions having mating shapes and corresponding locations, wherein the one or more protrusions of one wall member fit in the one or more recesses of an adjacent wall member.

14. The modular barrier system of claim 6, wherein each wall member includes a horizontal link-accepting groove on its outside, the link-accepting groove having a size that fits the links.

15. A modular barrier system comprising:

a plurality of plastic wall members, each including a shell which encloses a hollow space, and each linearly aligned with its nearest neighbor, thereby forming a piecewise continuous wall enclosing an area defined by that wall; and a plurality of elongated links, wherein each link is an elongated plate formed from steel and has two ends, and wherein each end of each link is connected to an end of its nearest neighboring link by a demountable fastener, thereby forming a closed chain of links, the chain of links being disposed against an outside of the wall, the outside of the wall being a side of the wall facing away from the enclosed area.

16. The modular barrier system of claim 15, wherein the plurality of wall members include straight wall members and curved wall members, and the plurality of links include straight links and curved links, and wherein the curved wall members form curved corners of the wall.

17. A method for installing a modular barrier system comprising:

laying a waterproof tarp on a ground surface;

placing a plurality of wall members on the tarp at defined locations, the wall members being disposed next to one another, forming a piecewise continuous wall which encloses an area defined by that wall;

placing a plurality of links against an outer side of the wall members, the outer side being a side facing away from the enclosed area, and connecting the plurality of links to each other to form a closed chain of links; and folding an edge portion of the tarp upwards along the outer side of the wall and securing the edge portions to the links.

18. The method of claim 17, wherein each wall member includes a horizontal link-accepting groove on its outer side, and wherein the step of placing the plurality of links against the outer side of the wall members includes snapping the links into the link-accepting grooves of the wall members.

19. The method of claim 17, wherein the step of securing the edge portions of the tarp to the links includes tying the edge portion of the tarp to the links via a plurality of grommets formed in the edge portions.

* * * * *